US005472218A

United States Patent [19]

Pratt

[11] Patent Number: 5,472,218

[45] Date of Patent: Dec. 5, 1995

[54] IN-LINE WHEELED SKATE AND TOE STOP

[75] Inventor: Michael K. Pratt, Ware, Mass.

[73] Assignee: Seneca Sports, Inc., Milford, Mass.

[21] Appl. No.: 223,978

[22] Filed: Apr. 6, 1994

Related U.S. Application Data

[63] Continuation-in-part of Ser. No. 17,316, Jan. 10, 1994.

[51] Int. Cl.[6] ..... A63C 17/14

[52] U.S. Cl. ..... 280/11.2; 188/5; 280/11.22

[58] Field of Search ..... 280/11.2, 11.22, 280/11.19; 188/5

[56] References Cited

U.S. PATENT DOCUMENTS

| | | | |
|---|---|---|---|
| Re. 32,346 | 2/1987 | Klamer et al. | 280/11.2 |
| 2,048,916 | 7/1936 | Bentzlin | 280/11.2 |
| 2,595,751 | 5/1952 | Balstad | 280/11.2 X |
| 2,631,861 | 3/1953 | Daniska | 280/11.2 |
| 2,644,692 | 7/1953 | Kahlert | 280/11.2 X |
| 5,052,701 | 10/1991 | Olson | 280/11.2 |
| 5,207,438 | 5/1993 | Landers | 280/11.2 |
| 5,295,701 | 3/1994 | Reiber et al. | 280/11.22 |

FOREIGN PATENT DOCUMENTS

| | | | |
|---|---|---|---|
| 3911899 | 10/1990 | Germany | A63C 17/06 |

OTHER PUBLICATIONS

Advertisement for "Skids" (*In–Line* magazine, Jun./Jul., 1994).

Advertisement for "Risport Galaxie" skates.

*Primary Examiner*—Eric D. Culbreth
*Assistant Examiner*—Michael Mar
*Attorney, Agent, or Firm*—Fish & Richardson

[57] ABSTRACT

An in-line wheeled skate includes a boot, a chassis attached beneath the boot, a plurality of wheels mounted thereupon and arranged in tandem, and a toe stop. The toe stop is fixedly mounted at the front of the chassis and defines a toe stop surface having a first, upper portion positioned relative to a chassis axis for engagement with a travel surface during movement to brake or slow motion of a skater and a second, lower portion positioned relative to the chassis axis for engagement with a travel surface during movement to impart push-off motion to a skater.

8 Claims, 5 Drawing Sheets

IN-LINE WHEELED SKATE AND TOE STOP

CROSS REFERENCE TO RELATED APPLICATIONS

This application is a continuation-in-part application of U.S. Ser. No. 29/017,316, filed Jan. 10, 1994, now pending.

BACKGROUND OF THE INVENTION

The invention relates to in-line wheeled skates.

The usual form of braking mechanism provided on wheeled skates, including both in-line skates, i.e. skates with the wheels arranged in tandem, and standard truck skates with the wheels arranged in pairs, is a rubber or plastic surfaced member mounted on an arm extending to the rear of the skate. As recognized also by others, a skater endeavoring to engage the rear braking surface of prior art in-line skates with the ground, or other travel surface, must extend his/her leg forward of the body, to a position that often places the skater off-balance, making it difficult to apply sufficient weight in a manner for safe braking.

Others have thought to address this problem. For example, German Patent 39 11 899 describes attachment, at the front of the skate, of a second stop member similar in form to the usual rear stop; and Landers U.S. Pat. No. 5,207,438 describes a cylinder, mounted on fixed or pivotable brackets at the front of an in-line skate, for applying a frictional braking force when rotated against the bracket arms by engagement with the ground.

SUMMARY OF THE INVENTION

According to one aspect of the invention, an in-line wheeled skate comprises a boot, a chassis attached beneath the boot and defining a chassis axis, a plurality of wheels mounted upon the chassis and arranged in tandem, and a toe stop member. the toe stop member is fixedly mounted at a front end of the chassis and defines a toe stop surface having a first, upper portion positioned relative to the chassis axis for engagement with a travel surface during movement to brake or slow motion of a skater and a second, lower portion positioned relative to the chassis axis for engagement with a travel surface during movement to impart push-off motion to a skater.

Preferred embodiments of this aspect of the invention may include one or more of the following additional features. The toe stop member defines a toe stop mounting surface having a first portion and a second portion and the chassis defines a chassis mounting surface having a first portion and a second portion, the first portion of the chassis mounting surface and the first portion of the toe stop mounting surface disposed in close opposition and adapted for engagement during braking or slowing engagement of the toe stop surface with a travel surface in a manner to resist movement of the toe stop member relative to the chassis, and the second portion of the chassis mounting surface and the second portion of the toe stop mounting surface disposed in close opposition and adapted for engagement during push-off engagement of the toe stop surface with a travel surface in a manner to resist movement of the toe stop member relative to the chassis. Preferably, the toe stop member has a side surface, the side surface defining a detent, and the toe stop member mounting surface comprises an arcuate wall bounding the detent. More preferably, the toe stop member defines a pair of side surfaces, each side surface defining a detent bounded by an arcuate wall comprising a toe stop member mounting surface, and the chassis comprising a pair of vertical side plates, each defining a chassis mounting surface. The toe stop surface is symmetrical about a toe stop member axis, with the first, upper portion lying generally above the toe stop member axis and the second, lower portion lying generally below the toe stop member axis. The toe stop member is fixedly mounted to the chassis by a pair of releasable fastener elements. Preferably, the releasable fastener elements are disposed symmetrically about the toe stop member axis, and toe stop member and chassis axes are parallel. The toe stop surface defines surface irregularities for enhanced frictional engagement with a travel surface. Preferably, the surface irregularities have the form of transverse ribs. A front-most wheel is mounted for rotation about an axle mounted to the chassis and disposed generally beneath a ball region of a skater's foot placed in the boot.

According to another aspect of the invention, an in-line wheeled skate comprises a boot, a chassis attached beneath the boot and defining a chassis axis, a plurality of wheels mounted upon the chassis and arranged in tandem, a front-most wheel being mounted for rotation about an axle mounted to the chassis and disposed generally beneath a ball region of a skater's foot placed in the boot, and a toe stop member, fixedly mounted at a front end of the chassis and defining a toe stop surface having a first, upper portion positioned relative to the chassis axis for engagement with a travel surface during movement to brake or slow motion of a skater and a second, lower portion positioned relative to the chassis axis for engagement with a travel surface during movement to impart push-off motion to a skater.

Objectives of this invention include providing a stop member mounted at the front end of an in-line skate for engagement with the ground, or other travel surface, to selectively allow a skater to push off or slow his/her progress. Also, the stop member is fixedly mounted at the front of the skate chassis, with cooperative surfaces of the stop member and chassis resisting displacement of the stop member relative to the chassis during both push-off and braking motions. The stop member may be mounted with releasable fasteners, e.g. symmetrically arranged, to allow the stop member to be removed and reversed to accommodate wear or, where the toe stop surface is asymmetrical, to allow the skater to elect between braking surface angles. Also, the front-most wheel and axle may be disposed beneath the ball of the skater's foot for improved balance and stability during braking and push-off.

These and other features and advantages of the invention will be apparent from the following description of a presently preferred embodiment, and from the claims.

BRIEF DESCRIPTION OF THE DRAWINGS

We first briefly describe the drawings.

DESCRIPTION OF THE PREFERRED EMBODIMENTS

Figure 1:
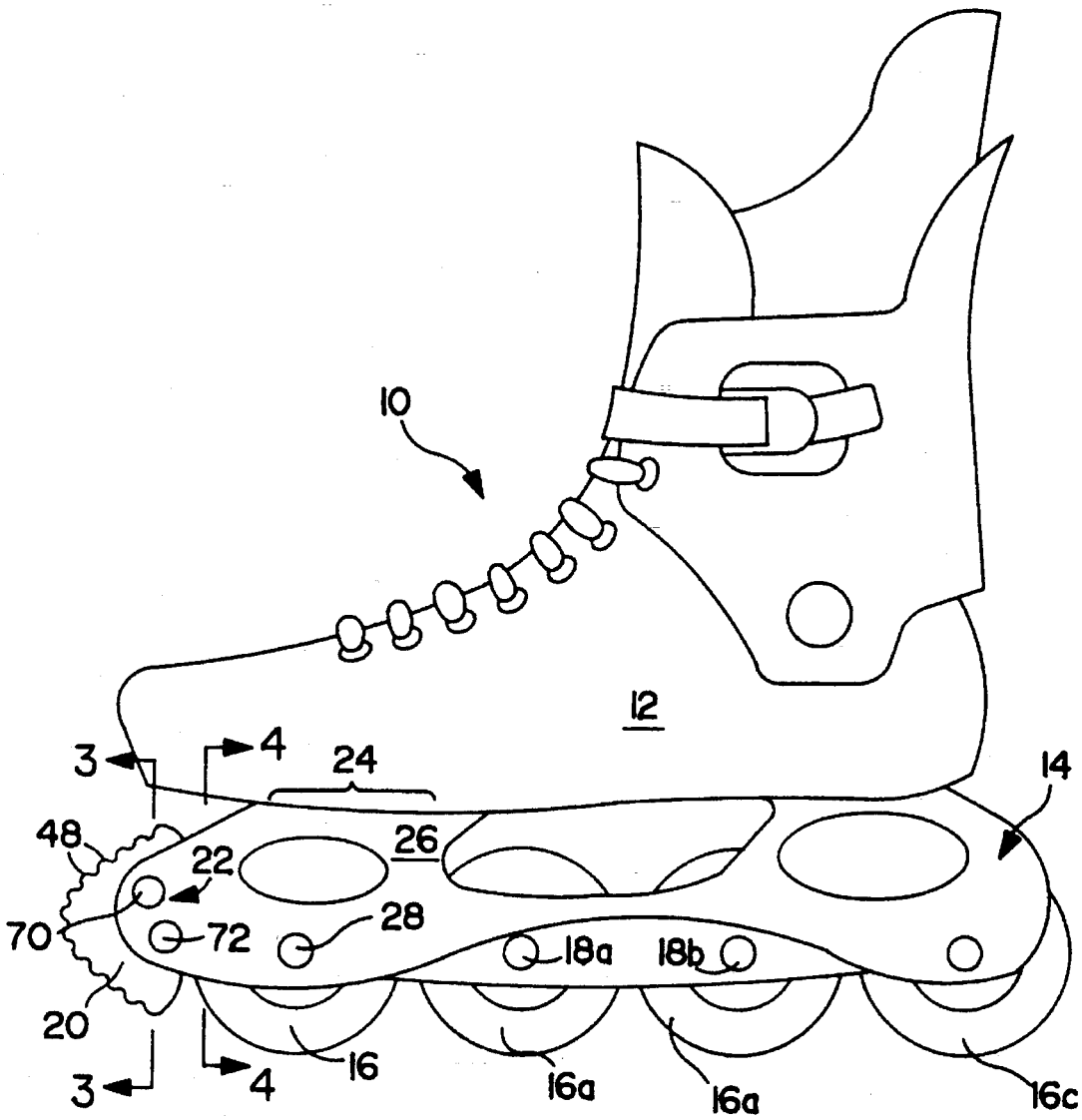
FIG. 1 is a side view of an in-line wheeled skate and toe stop of the invention.
Figure 7:
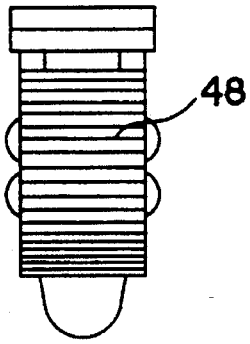
FIG. 7 is a front view of the in-line wheeled skate and toe stop of FIG. 1;.
Figure 2:
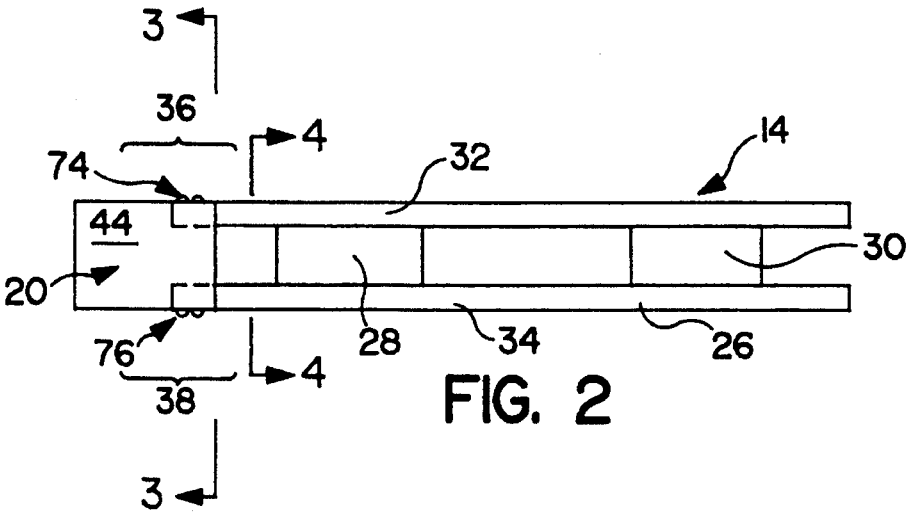
FIG. 2 is a bottom plan view of the chassis with toe stop of FIG. 1.
Figure 3:
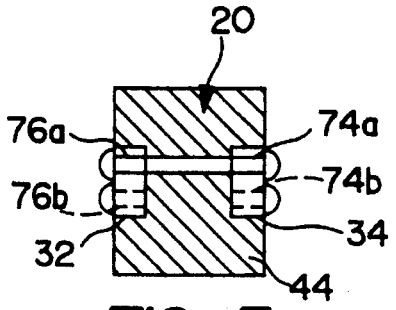
FIG. 3 is a sectional view of the chassis and toe stop taken at the line 3—3 of FIGS. 1 and 2.
Figure 4:
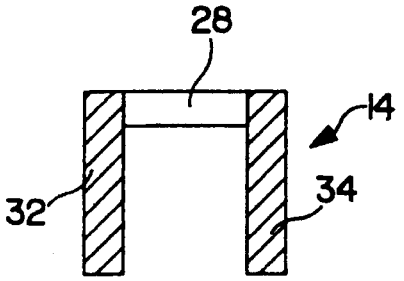
FIG. 4 is a front sectional view of the chassis taken at the line 4—4 of FIGS. 1 and 2.
Figure 5:
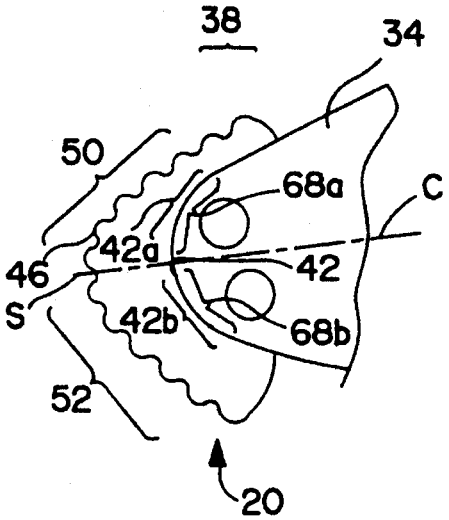
FIG. 5 is a somewhat diagrammatic enlarged first side view of the toe stop member and chassis front end region of the in-line wheeled skate of FIG. 1.
Figure 6:
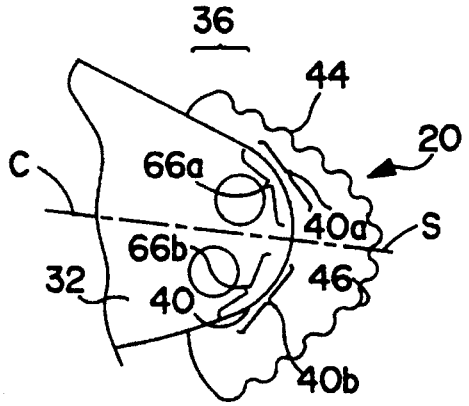
FIG. 6 is a similar, somewhat diagrammatic enlarged opposite side view of the toe stop member and chassis front end region of the in-line wheeled skate of FIG. 1.
Figure 8:
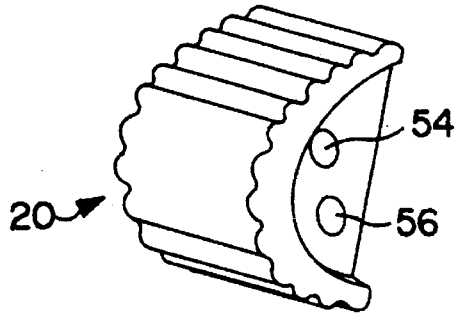
FIG. 8 is a perspective view of a toe stop of the invention.
Figure 9:
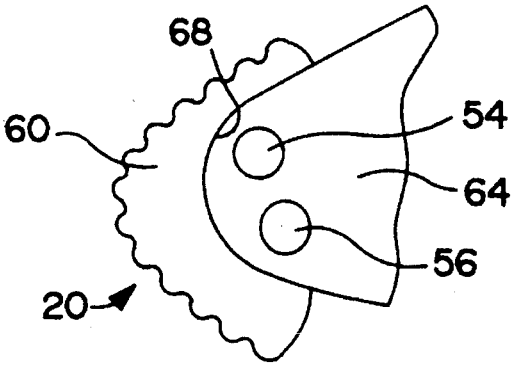
FIGS. 9 and 10 are respective first and second side views of the toe stop of FIG. 8.
Figure 10:
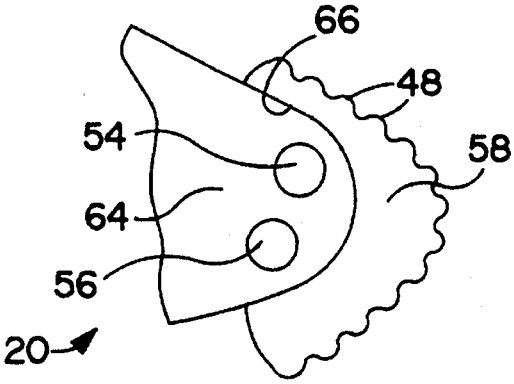
Figure 11:
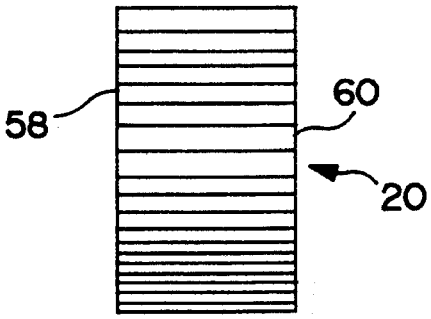
FIG. 11 is a front view of the toe stop of FIG. 8.
Figure 12:
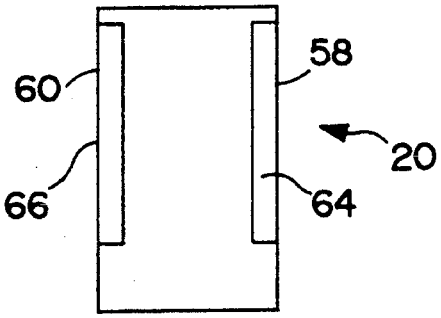
FIG. 12 is a rear view of the toe stop of FIG. 8.
Figure 13:
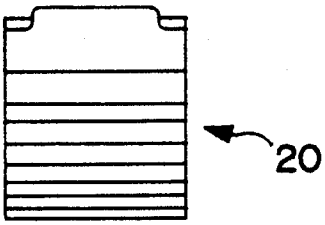
FIG. 13 is a top view of the toe stop of FIG. 8.
Figure 14:
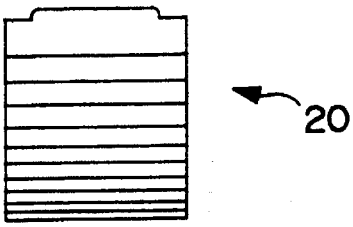
FIG. 14 is a bottom view of the toe stop of FIG. 8.

Referring to FIG. 1, an in-line skate 10 of the invention has a boot 12 mounted on a chassis 14, with a plurality, e.g. four, wheels 16, 16*a*, 16*b*, 16*c* arranged in tandem on axles 18, 18*a*, 18*b*, 18*c*, respectively. A toe stop member 20 is fixedly mounted at the front end 22 of the chassis, and the axle 18 of the front-most wheel 16 is disposed beneath the region 24 of the ball of a skater's foot in the boot 12, for improved stability, as discussed below.

Referring also to FIGS. 2–6, the chassis 14 has a body 26 consisting of front and rear foot plates 28, 30, to which the boot 12 is attached, and a pair of opposed vertical side plates 32, 34, between which are mounted the wheels 16 et seq. The front end regions 36, 38 of the vertical side plates 32, 34 define arcuate front chassis wall surfaces 40, 42, each having a first, upper portion and a second, lower portion 40*a*, 40*b* and 42*a*, 42*b*, respectively, symmetrically arranged above and below an axis, C, of the chassis.

Referring to FIGS. 5–14, the toe stop member 20 has a body 44 formed, e.g. by molding, of poly-urethane, rubber or other suitable material. The body 44 defines a toe stop surface 46 which in the preferred embodiment defines a series of transverse ribs 48 to further enhance positive engagement of the toe stop surface with a travel surface during push-off or braking. The toe stop surface 46 has a first, upper portion 50 and a second, lower portion 52, which in the preferred embodiment are disposed symmetrically above and below a toe stop member axis, S. A pair of parallel fastener apertures 54, 56, defined through the toe stop member body 44 are also positioned symmetrically relative to the axis, S. The body 44 also has first and second side surfaces 58, 60, each defining a toe stop detent 62, 64, respectively, sized and shaped to receive the respective corresponding front end regions 36, 38, of the chassis body 26, with arcuate bounding wall surfaces 66, 68 of the respective toe stop detents 62, 64 shaped for cooperative engagement with opposed front wall surfaces 40, 42 of the chassis vertical side walls 32, 34 when the toe stop member 20 is mounted to the chassis 14. More particularly, the arcuate bounding wall surfaces 66, 68 of the toe stop detents 62, 64 each have a first, upper portion and a second, lower portion, 66*a*, 66*b* and 68*a*, 68*b*, respectively.

The toe stop 20 is mounted at the front of the chassis 14, between the vertical side plates 32, 34, by a pair of releasable fastener elements 70, 72 extending through cooperating fastener apertures pairs 74, 76 provided in the front end regions 36, 38 of the chassis vertical side plates 32, 34 and the corresponding fastener apertures 54, 56 of the toe stop member body 44. (In the preferred embodiment, the apertures 74*a*, 74*b* and 76*a*, 76*b* of chassis fastener aperture pairs 74, 76 are disposed symmetrical to axis, C, of the chassis, and the axes 5 and C are parallel. Other arrangements are described below.) The respective upper and lower wall portions of the chassis wall surfaces and the bounding wall surfaces of the toe stop detents 40*a*, 66*a*; 42*a*, 68*a*; 40*b*, 66*b*; 42*b*, 68*b* are thus disposed in a cooperative, opposed relationship for the purpose of resisting displacement of the toe stop during push-off and stopping, as we will now describe.

As described above, the side surfaces 58, 60 of the toe stop body 44 define detents 62, 64 for receiving the front end regions 36, 38 of the vertical side plates 32, 34 of the chassis body 26. The detents 62, 64 are bounded by arcuate wall surfaces 66, 68, and the regions 36, 38 of the chassis define correspondingly shaped arcuate wall surface 40, 42.

According to the invention, transfer of force during pushing off and braking motions is facilitated, and movement of the toe stop member 20 relative to the chassis 14 is resisted, as a result of this relationship of elements.

Figure 15:
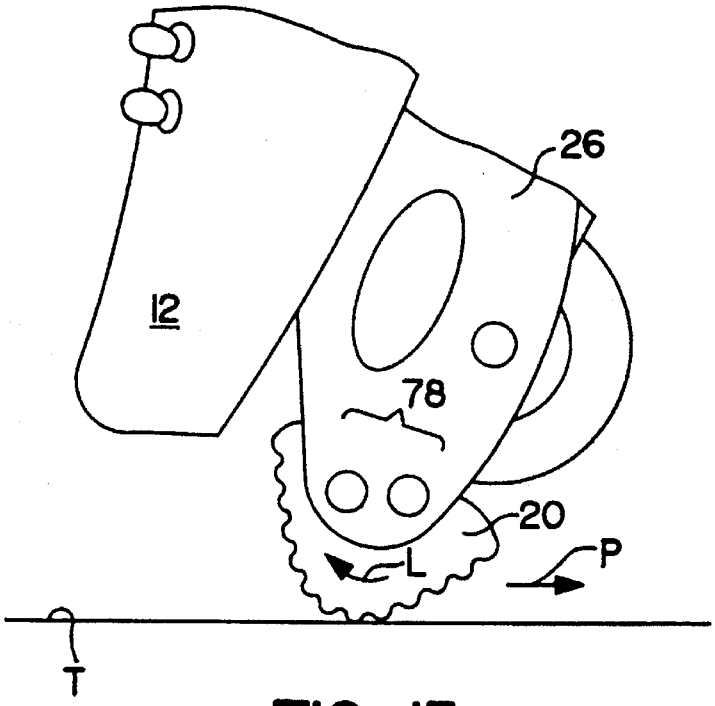
FIG. 15 is a somewhat diagrammatic side view of an in-line wheeled skate and toe stop of the invention during a pushing-off motion.

Referring now to FIG. 15, during push-off or starting motion, a skater wearing an in-line wheeled skate 10 of the invention moves the pushing skate toward the rear, angling the skate in a manner to engage the surface 46 of the toe stop member 20 with the travel surface, T, and exerting a pushing off force (arrow, P) to propel the skater forward. In response to application of the force, P, the toe stop member 20 is urged to pivot or rotate about the fastener region 78 (arrow L) resulting in a loss of force, and also in wear (and likely ultimate failure or dislodgement) of the toe stop body. However, in the arrangement of the invention, interengagement of the opposed first, upper portions 40*a*, 66*a* and 42*a*, 68*a* of the arcuate wall surfaces 66, 68 of the toe stop body 44 and the correspondingly shaped arcuate wall surfaces 40, 42 of the chassis body 26 supports the toe stop and resists movement relative to the chassis.

Figure 16:
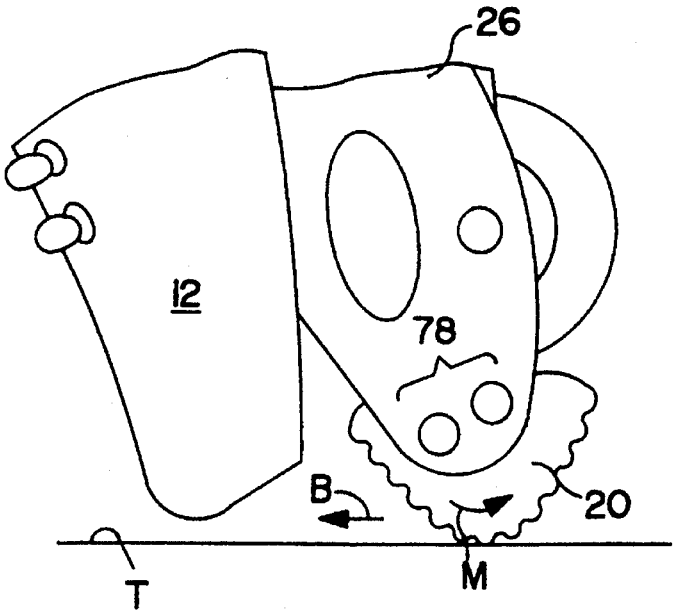
FIG. 16 is a similar, somewhat diagrammatic side view of an in-line wheeled skate and toe stop of the invention during a braking motion.

Similarly, with reference to FIG. 16, during braking motion, a skater wearing an in-line wheeled skate 10 of the invention places the braking skate toward the rear, then angles the skate in a manner to engage the surface 46 of the toe stop member 20 with the travel surface, T, to exert a braking or dragging force (arrow, B) to slow or stop the skater. In response to application of the force, B, the toe stop member 20 is again urged to pivot or rotate about the fastener region 78 (arrow M) resulting in a loss of force, and also in wear (and likely ultimate failure or dislodgement) of the toe stop body. However, in the arrangement of the invention, interengagement of the opposed second, lower portions 40*b*, 66*b* and 42*b*, 68*b* of the arcuate wall surfaces 66, 68 of the toe stop body 44 and the correspondingly shaped arcuate wall surfaces 40, 42 of the chassis body 26 supports the toe stop and resists movement relative to the chassis.

Other embodiments are within the following claims. For example, referring to FIGS. 17–20, a skater is permitted the ability to adjust the position and/or angle of the toe stop surface relative to the travel surface.

Figure 17:
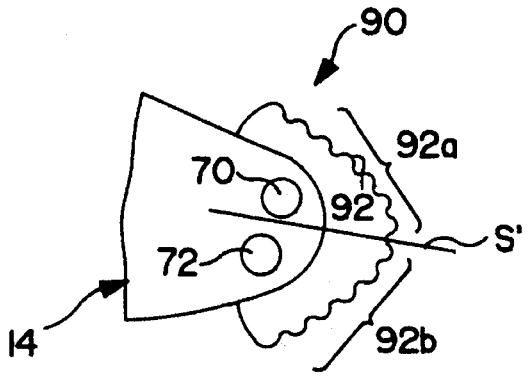
FIGS. 17, 18, 19, and 20 are side views of other embodiments of the in-line wheeled skate and toe stop of the invention.

In FIG. 17, a toe stop 90 has a toe stop surface 92 with respective upper and lower portions 92*a*, 92*b* that are asymmetrical to the axis, S', of the toe stop, and the skater can change the angle and/or position by removing the releasable fastener elements 70, 72, and reversing the toe stop member 90 relative to the chassis 14 before replacing the fasteners.

Figure 18:
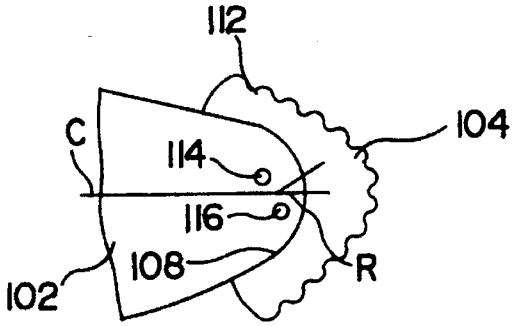
Figure 19:
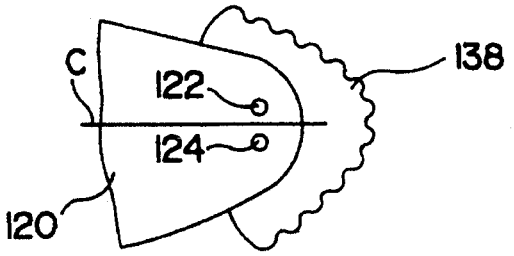
Figure 20:
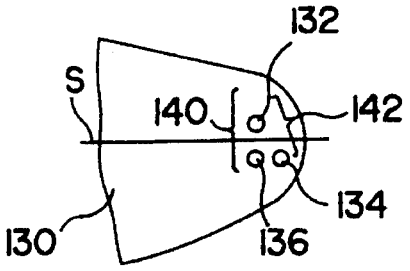

Also, referring to FIG. 18, an in-line wheeled skate 100 of the invention may have a chassis 102 having vertical side plates 104 with end wall surfaces 108 having a uniform radius, R, and a toe stop member 112 with an axis, S", about which the fastener apertures 114, 116 are symmetrically placed, that may be skewed relative to the axis, C, of the chassis 102. Referring to FIG. 19, a chassis 120 may define fastener aperture holes 122, 124 that are symmetrically arranged relative to the chassis axis, C, which also passes through toe stop 138, or, referring to FIG. 20, a chassis 130 may define fastener aperture holes 132, 134, 136 permitting adjustment of the mounting position of a toe stop member between the arrangement of FIG. 18 and FIG. 19, e.g., two pairs of holes 140, 142, with a single hole 132 in common.

What is claimed is:

1. An in-line wheeled skate comprising a boot, a chassis attached beneath said boot and defining a central longitudinal chassis axis, a plurality of wheels mounted upon said chassis and arranged in tandem, and a toe stop member, fixedly mounted at a front end of said chassis and defining a forwardly facing curved toe stop surface having a first, upper portion positioned relative to said chassis axis for engagement with a travel surface during movement to brake or slow motion of a skater and a second, lower portion positioned relative to said chassis axis for engagement with a travel surface during movement to impart push-off motion to a skater, said toe stop member having a first side surface defining a first portion of a toe stop mounting surface comprising a first detent bounded by a first arcuate wall, and said toe stop member having a second, opposite side surface defining a second portion of a toe stop mounting surface comprising a second detent bounded by a second arcuate wall, each of said first and said second arcuate walls having upper and lower walls which converge at an angle of less than 90 degrees, and said chassis comprising a pair of vertical side plates, a first said side plate defining a first portion of a chassis mounting surface bounded by a first arcuate edge and a second said side plate defining a second portion of a chassis mounting surface bounded by a second arcuate edge, each of said first and said second arcuate edges having upper and lower edges which converge at an angle of less than 90 degrees, said first portion of said chassis mounting surface and said first portion of said toe stop mounting surface disposed in surface-to-surface engagement, with said first arcuate wall and said first arcuate edge disposed in closely opposed relationship, said second portion of said chassis mounting surface and said second portion of said toe stop mounting surface disposed in surface-to-surface engagement, with said second arcuate wall and said second arcuate edge disposed in closely opposed relationship, and each of said first and said second portions of said chassis mounting surface includes an upper section located above the chassis axis and a lower section located below the chassis axis and each of said first and said second portions of said toe stop mounting surfaces includes an upper section located above the chassis axis and a lower section located below the chassis axis, and wherein said first portion of said chassis mounting surface is received within said first detent and said second portion of said chassis mounting surface is received within said second detent.

2. The in-line wheeled skate of claim 1 wherein said toe stop surface is symmetrical about a toe stop member axis, with said first, upper portion lying generally above said toe stop member axis and said second, lower portion lying generally below said toe stop member axis.

3. The in-line wheeled skate of claim 1 wherein said toe stop member is fixedly mounted to said chassis by a pair of releasable fastener elements.

4. The in-line wheeled skate of 3 wherein said releasable fastener elements are disposed symmetrically about said toe stop member axis.

5. The in-line wheeled skate of claim 3 wherein said toe stop member axis and said chassis axis are parallel.

6. The in-line wheeled skate of claim 1 wherein said toe stop surface defines surface irregularities for enhanced frictional engagement with a travel surface.

7. The in-line wheeled skate of claim 6 wherein said surface irregularities have the form of transverse ribs.

8. The in-line wheeled skate of claim 1, wherein a front-most said wheel is mounted for rotation about an axle mounted to said chassis and disposed generally beneath a ball region of a skater's foot placed in said boot.

* * * * *

UNITED STATES PATENT AND TRADEMARK OFFICE

CERTIFICATE OF CORRECTION

PATENT NO. : 5,472,218

DATED : December 5, 1995

INVENTOR(S) : Michael K. Pratt

It is certified that error appears in the above-identified patent and that said Letters Patent is hereby corrected as shown below:

Col. 2, line 60, delete "front".

Col. 4, line 10, "5" should be --S--.

Signed and Sealed this

Twenty-ninth Day of October 1996

Bruce Lehman

*Attest:*

BRUCE LEHMAN

*Attesting Officer*

*Commissioner of Patents and Trademarks*